US010524071B2

(12) United States Patent
Niedermann

(10) Patent No.: US 10,524,071 B2
(45) Date of Patent: Dec. 31, 2019

(54) INTEGRATED VOICE COIL AND CONE ASSEMBLY AND METHOD OF MAKING SAME

(71) Applicant: EAGLE ACOUSTICS MANUFACTURING, LLC, Highland Park, IL (US)

(72) Inventor: Paul Niedermann, Rockford, IL (US)

(73) Assignee: EAGLE ACOUSTICS MANUFACTURING, LLC, Highland Park, IL (US)

( * ) Notice: Subject to any disclaimer, the term of this patent is extended or adjusted under 35 U.S.C. 154(b) by 257 days.

(21) Appl. No.: 15/532,311

(22) PCT Filed: Feb. 5, 2016

(86) PCT No.: PCT/US2016/016791
§ 371 (c)(1),
(2) Date: Jun. 1, 2017

(87) PCT Pub. No.: WO2016/127062
PCT Pub. Date: Aug. 11, 2016

(65) Prior Publication Data

US 2017/0374483 A1 Dec. 28, 2017

Related U.S. Application Data

(60) Provisional application No. 62/112,535, filed on Feb. 5, 2015.

(51) Int. Cl.
*H04R 7/08* (2006.01)
*H04R 31/00* (2006.01)
(Continued)

(52) U.S. Cl.
CPC ..... *H04R 31/003* (2013.01); *H04R 7/10* (2013.01); *H04R 9/045* (2013.01); *H04R 9/06* (2013.01); *H04R 2307/025* (2013.01)

(58) Field of Classification Search
CPC ... H04R 7/08; H04R 7/02; H04R 7/16; H04R 7/10; H04R 7/122; H04R 7/125; H04R 31/003; H04R 31/00
See application file for complete search history.

(56) References Cited

U.S. PATENT DOCUMENTS 3,153,463 A * 10/1964 Novak ..... H04R 7/02 381/182
3,172,498 A * 3/1965 Gorike ..... H04R 1/22 181/167

(Continued)

FOREIGN PATENT DOCUMENTS

DE 102012108258 A1 * 3/2014 ..... H04R 7/10
GB 1270033 A * 4/1972 ..... H04R 7/02
JP 57063996 A * 4/1982 ..... H04R 7/10

*Primary Examiner* — Edgardo San Martin
(74) *Attorney, Agent, or Firm* — Clark Hill PLC; James R. Foley

(57) ABSTRACT

An integrated voice coil and cone assembly includes a cone assembly having a top diaphragm skin and a bottom diaphragm skin with a space between the top diaphragm skin and bottom diaphragm skin. The integrated voice coil and cone assembly also includes a voice coil configured to engage the cone assembly along a perimeter edge thereof and an adhesive material placed between the top diaphragm skin and bottom diaphragm skin such that the adhesive material fills all of the space between the top and bottom diaphragm skins. The adhesive material also bonds the top diaphragm skin, bottom diaphragm skin, and voice coil into a single, integrated unit.

20 Claims, 10 Drawing Sheets

(51) Int. Cl.

| | |
|---|---|
| ***H04R 7/10*** | (2006.01) |
| ***H04R 9/06*** | (2006.01) |
| ***H04R 9/04*** | (2006.01) |
| *H04R 7/00* | (2006.01) |

(56) References Cited

U.S. PATENT DOCUMENTS 3,603,427 A * 9/1971 Sotome ..... H04R 7/02 181/166
3,834,486 A * 9/1974 Tsuge ..... H04R 7/122 181/165
4,163,876 A * 8/1979 Ohnuki ..... H04R 7/04 181/170
4,275,278 A * 6/1981 Sakurai ..... H04R 7/122 181/166
4,384,174 A * 5/1983 Suzuki ..... H04R 7/02 181/170
4,395,597 A * 7/1983 Suzuki ..... H04R 7/12 181/170
4,620,606 A * 11/1986 Suzuki ..... H04R 7/04 181/170
4,635,750 A * 1/1987 Suzuki ..... H04R 9/045 181/171
5,259,036 A * 11/1993 Seeler ..... H04R 7/125 181/170
6,176,345 B1 * 1/2001 Perkins ..... H04R 7/00 181/171
6,330,340 B1 12/2001 Proni
6,862,361 B2 * 3/2005 James ..... H04R 9/046 181/171
7,209,570 B2 * 4/2007 Funahashi ..... H04R 9/043 381/398
7,317,810 B2 * 1/2008 Ohashi ..... H04R 9/025 381/186
7,510,048 B2 * 3/2009 Nevill ..... H04R 7/14 181/174
7,568,552 B2 * 8/2009 Litovsky ..... H04R 7/20 181/171
9,071,898 B2 * 6/2015 Cazes Bouchet ..... H04R 7/04
10,028,060 B2 * 7/2018 Foglia ..... H04R 7/122
2002/0146145 A1 10/2002 James et al.
2003/0068064 A1 4/2003 Czerwinski
2004/0129492 A1 7/2004 Bertagni et al.
2012/0250931 A1 10/2012 Diedrich et al.
2013/0266173 A1 10/2013 Niedermann
2014/0119579 A1 * 5/2014 Servado ..... H04R 9/025 381/162
2015/0326960 A1 * 11/2015 Niedermann ..... H04R 5/00 381/300

* cited by examiner

INTEGRATED VOICE COIL AND CONE ASSEMBLY AND METHOD OF MAKING SAME

RELATED APPLICATION (PRIORITY CLAIM)

This application claims the benefit of Provisional Application Ser. No. 62/112,535, filed Feb. 5, 2015, which is hereby incorporated herein by reference in its entirety.

BACKGROUND OF THE INVENTION

This invention generally relates to audio speakers and components therefor, and methods for making same.

In conventional audio speakers for consumer electronic devices, the separate components of the speaker are assembled at the same time. Typically the driver, surround cone, voice coil, and spider are assembled manually. As a result, the process for manufacturing speakers is often time-consuming and can be somewhat expensive.

It would therefore be desirable to have integral components which could simplify the manufacturing process and reduce the assembly costs for speakers. Embodiments of the invention provide such an integral component. These and other advantages of the invention, as well as additional inventive features, will be apparent from the description of the invention provided herein.

Traditional methods for building speaker diaphragms and cones, while being light weight, leaves them thin and soft contributing to them being easily damaged and naturally distorting the sound they reproduce.

BRIEF SUMMARY OF THE INVENTION

In one aspect, embodiments of the invention provide an integrated voice coil and cone assembly includes a cone assembly having a top diaphragm skin and a bottom diaphragm skin with a space between the top diaphragm skin and bottom diaphragm skin. The integrated voice coil and cone assembly also includes a voice coil configured to engage the cone assembly along a perimeter edge thereof, and an adhesive material placed between the top diaphragm skin and bottom diaphragm skin such that the adhesive material fills all of the space between the top and bottom diaphragm skins. The adhesive material also bonds the top diaphragm skin, bottom diaphragm skin, and voice coil into a single unit.

In a particular embodiment, the adhesive material is a polyurethane foam wherein the polyurethane foam, before application, has a density of between two and six pounds per cubic foot. In a more particular embodiment, the adhesive material is a polyurethane foam that, before application, has a density of approximately four pounds per cubic foot. In a further embodiment, after application, the adhesive material becomes rigid.

In certain embodiments, one of the top diaphragm skin and bottom diaphragm skin is flat while the other of the top diaphragm skin and bottom diaphragm skin has a recessed area, such as a recessed center portion. The top and bottom diaphragm skins may be circular and of the same diameter, and the voice coil may engage the top and bottom diaphragm skins along the entire circumference of both top and bottom diaphragm skins. In some embodiments, the top and bottom diaphragm skins are comprised of paper. Also, the voice coil may be ring-shaped with a plurality of holes around a circumference of the voice coil, and the plurality of holes located such that the adhesive flows through the holes.

In another aspect, embodiments of the invention provide a method of manufacturing an integrated voice coil and cone assembly. The method includes aligning an interior surface of a ring-shaped voice coil with a perimeter edge of a cone assembly, and attaching the voice coil to the perimeter edge of the cone assembly, the cone assembly comprising a top diaphragm skin and bottom diaphragm skin. Attaching the voice coil to the perimeter edge of the cone assembly calls for filling an entire space between the top diaphragm skin and bottom diaphragm skin with an adhesive, which bonds the top diaphragm skin, bottom diaphragm skin, and voice coil into a single, integral unit.

An embodiment of the method includes filling an entire space between the top diaphragm skin and bottom diaphragm skin with a polyurethane foam. In certain embodiments, the method calls for filling an entire space between the top diaphragm skin and bottom diaphragm skin with a polyurethane foam having a density of between three and five pounds per cubic foot. In a more particular embodiment, the method includes filling an entire space between the top diaphragm skin and bottom diaphragm skin with a polyurethane foam having a density of approximately four pounds per cubic foot. The method may include allowing the adhesive to set until it becomes rigid.

Embodiments of the method include aligning an interior surface of a ring-shaped voice coil with a perimeter edge of a cone assembly having a stacked top diaphragm skin and bottom diaphragm skin, wherein the top and bottom diaphragm skins are comprised of paper. In a further embodiment, the method includes aligning an interior surface of a ring-shaped voice coil with a perimeter edge of a cone assembly having a stacked top diaphragm skin and bottom diaphragm skin, wherein one of the top diaphragm skin and bottom diaphragm skin is flat while the other of the top diaphragm skin and bottom diaphragm skin has a recessed center portion.

This method of assembly, in accordance with an embodiment of the present invention, increases the stiffness and strength of the entire diaphragm structure yet keeps it light weight, thereby maximizing resiliency and minimizing distortion for improved sound quality.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
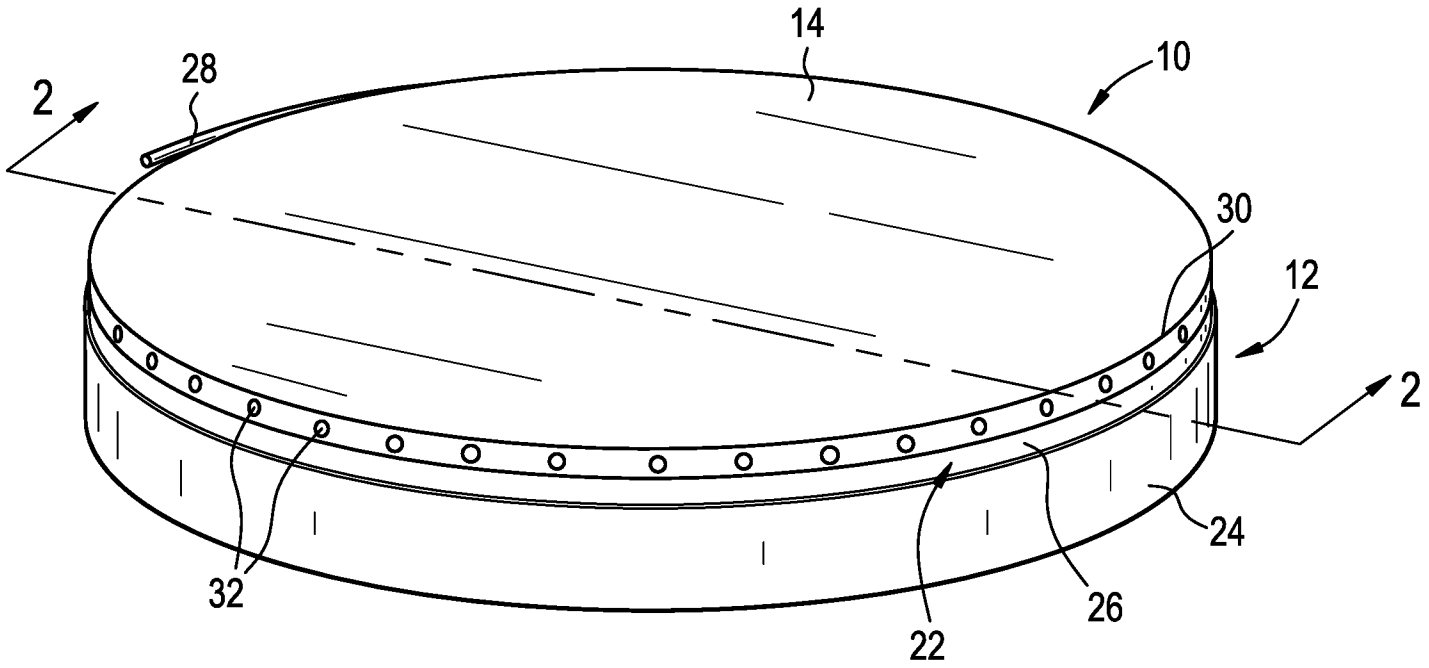
FIG. 1 is a perspective view of an integrated voice coil and cone assembly in accordance with an embodiment of the present invention.

The accompanying figures in the drawings submitted herewith show the detailed assembly of the integral voice coil and cone assembly, constructed in accordance with an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF ILLUSTRATED EMBODIMENTS OF THE INVENTION

The accompanying figures illustrate an exemplary process for assembling the integral voice coil and cone assembly, in accordance with an embodiment of the invention.

In one aspect, embodiments of the invention provide an integrated voice coil and cone assembly includes a cone assembly having a top diaphragm skin and a bottom diaphragm skin with a space between the top diaphragm skin and bottom diaphragm skin. The integrated voice coil and cone assembly also includes a voice coil configured to engage the cone assembly along a perimeter edge thereof, and an adhesive material placed between the top diaphragm skin and bottom diaphragm skin such that the adhesive material fills all of the space between the top and bottom diaphragm skins. The adhesive material also bonds the top diaphragm skin, bottom diaphragm skin, and voice coil into a single, integrated unit.

Figure 2:
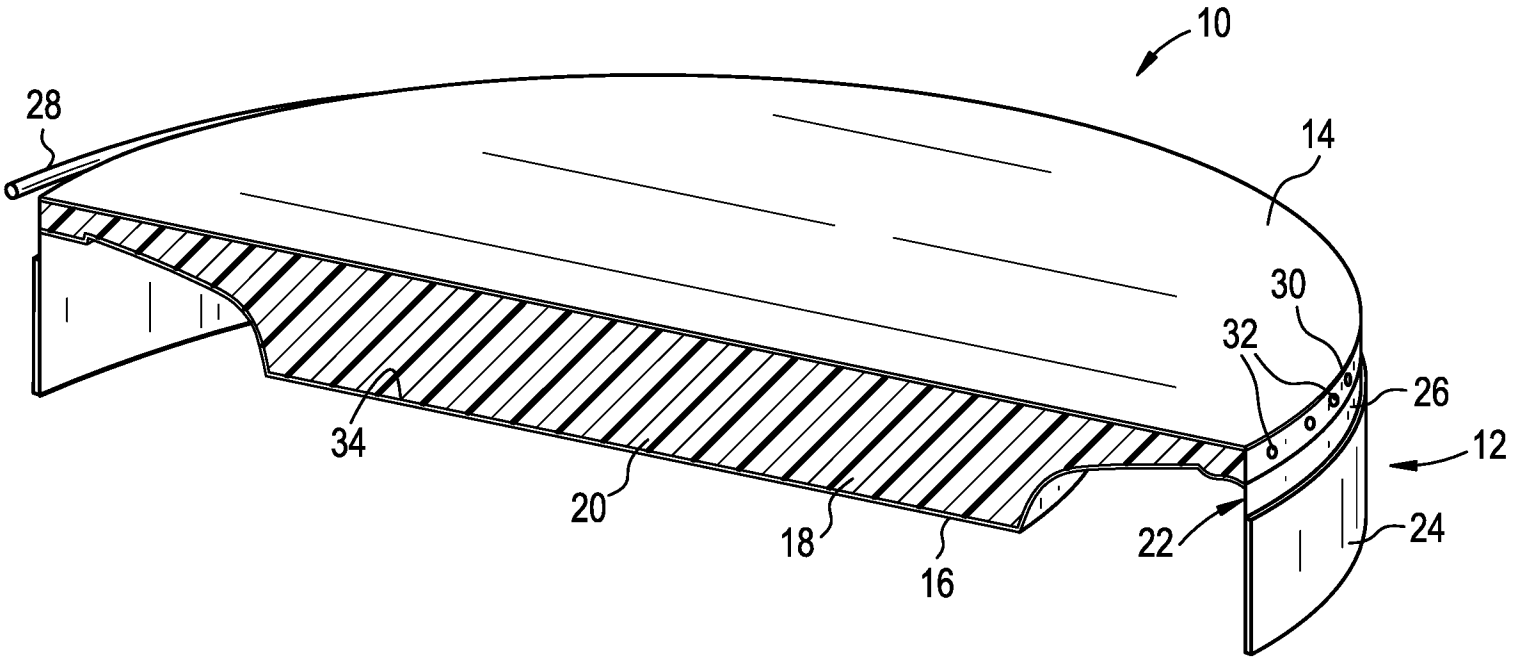
FIG. 2 is a perspective, cross-sectional view of the assembly shown in FIG. 1, taken along line 2-2 of FIG. 1.
Figure 3:
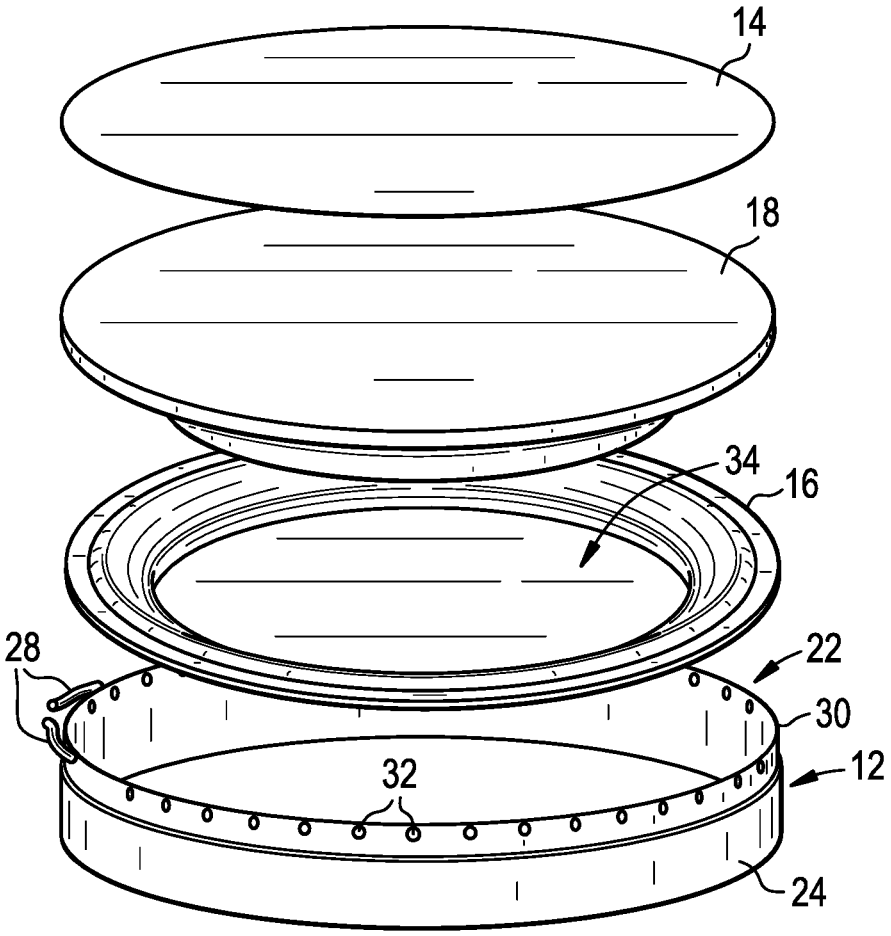
FIG. 3 is an exploded view of the assembly shown in FIG. 1.

FIG. 1 is a perspective view of one such integrated voice coil and cone assembly 10 which is in accordance with an embodiment of the present invention. FIG. 2 is a perspective, cross-sectional view of the assembly 10 shown in FIG. 1, taken along line 2-2 of FIG. 1. FIG. 3 provides an exploded view of the assembly 10.

As shown in FIGS. 1-3, the assembly 10 may comprise a voice coil 12, a top diaphragm skin 14, a bottom diaphragm skin 16 (not visible in FIG. 1), and an adhesive material 18 disposed between the two skins 14, 16 (not visible in FIG. 1).

As shown in FIG. 2, the adhesive material 18 bonds the top diaphragm skin 14, the bottom diaphragm skin 16, and the voice coil 12 into a single, integrated unit 10. Specifically, the adhesive material 18 is disposed in a space 20 between the top diaphragm skin 14 and the bottom diaphragm skin 16, and preferably fills substantially the entire space 20. Both skins 14, 16 may be formed of, for example, paper, composite, plastic or metal(s).

The voice coil 12 may comprise a former 22 which is comprised of stiff paperboard (i.e., kraft paper), composite (i.e., fiberglass or aramid), plastic (i.e., polyimide film), or Aluminum, which has an electrical winding (or laminate) 24 disposed about its perimeter, on an exterior surface 26 thereof, and which terminates at electrical leads 28 (one of which is shown in FIG. 2, and both of which are shown in FIG. 3). Proximate a top edge 30 of the former 22, there may be disposed a plurality of holes 32 through at least one of which the adhesive material 18 has been poured, injected or otherwise installed during manufacture of the assembly 10. With regard to the holes 32, excess adhesive or polyurethane 18 will flow out those holes as well, and if each hole has some excess that has flowed out, it insures that good adhesive contact has been made with the full perimeter of the voice coil former 22.

The adhesive material 18 may comprise, for example, a polyurethane foam wherein the polyurethane foam, before application, has a density of between two and six pounds per cubic foot. More specifically, the adhesive material 18 may comprise polyurethane foam that, before application, has a density of approximately four pounds per cubic foot. In the context of the present invention, the term "approximately", as applied to the density of the polyurethane foam, means within plus or minus 10% of the nominal, or stated, value. In a further embodiment of the invention, the adhesive material 18 is configured such that, after application, the adhesive material 18 becomes rigid after it has been allowed to set.

In certain embodiments, one of the top diaphragm skin 14 and bottom diaphragm skin 16 is flat while the other of the top diaphragm skin 14 and bottom diaphragm skin 16 has a recessed area 34, such as a recessed center area. The top and bottom diaphragm skins 14 and 16 may be circular and of the same diameter, and the voice coil 12 may engage the top and bottom diaphragm skins 14 and 16 along the entire circumference of both top and bottom diaphragm skins 14 and 16. Both the top and bottom diaphragm skins 14 and 16 may be comprised of, for example, paper, composite, plastic or metal(s). The voice coil 12 may be ring-shaped with a plurality of holes 32 around a circumference of the former 22, and the plurality of holes 32 located such that (during production) the adhesive 18 flows into the space 20 between the skins 14 and 16, through at least one of the holes 32 (during which time the other holes may be covered with, for example, masking tape).

Figure 4:
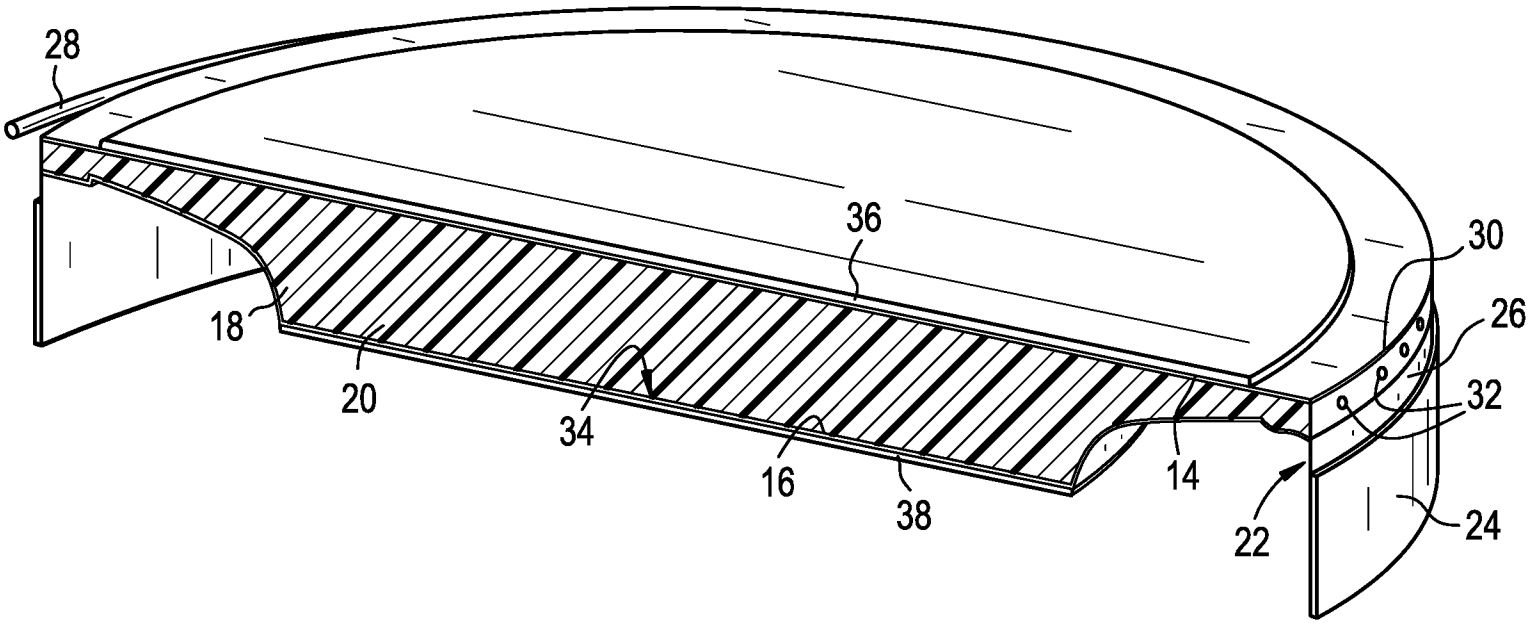
FIG. 4 is a view much like FIG. 2, but shows an alternative embodiment wherein appliques are attached to the top and bottom diaphragm skins.
Figure 5:
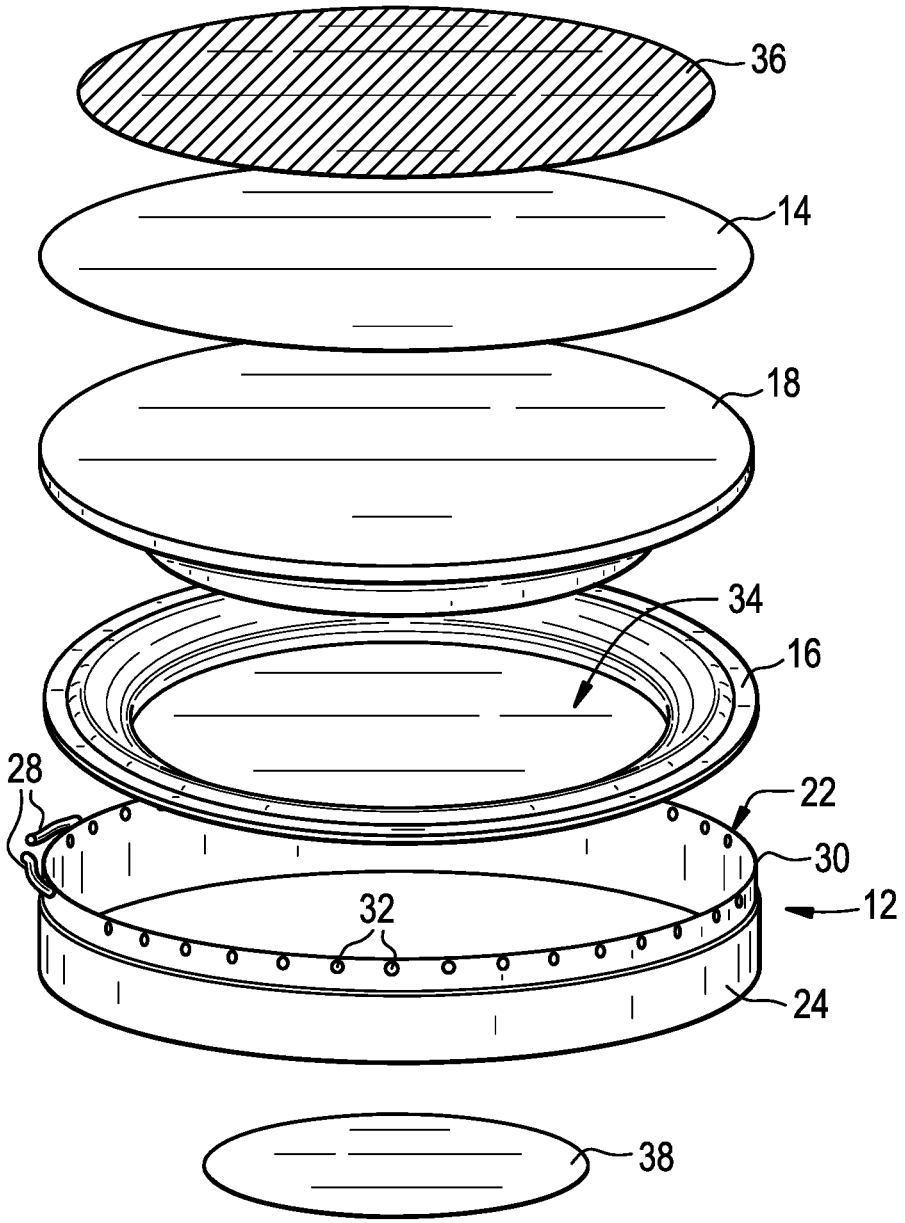
FIG. 5 is an exploded perspective view of the assembly shown in FIG. 4.

FIG. 4 is a view much like FIG. 2, but shows an alternative embodiment wherein appliques 36, 38 are attached to the top and bottom diaphragm skins 14 and 16, respectively, while FIG. 5 is an exploded perspective view of the alternative embodiment which is shown in FIG. 4.

Figure 6:
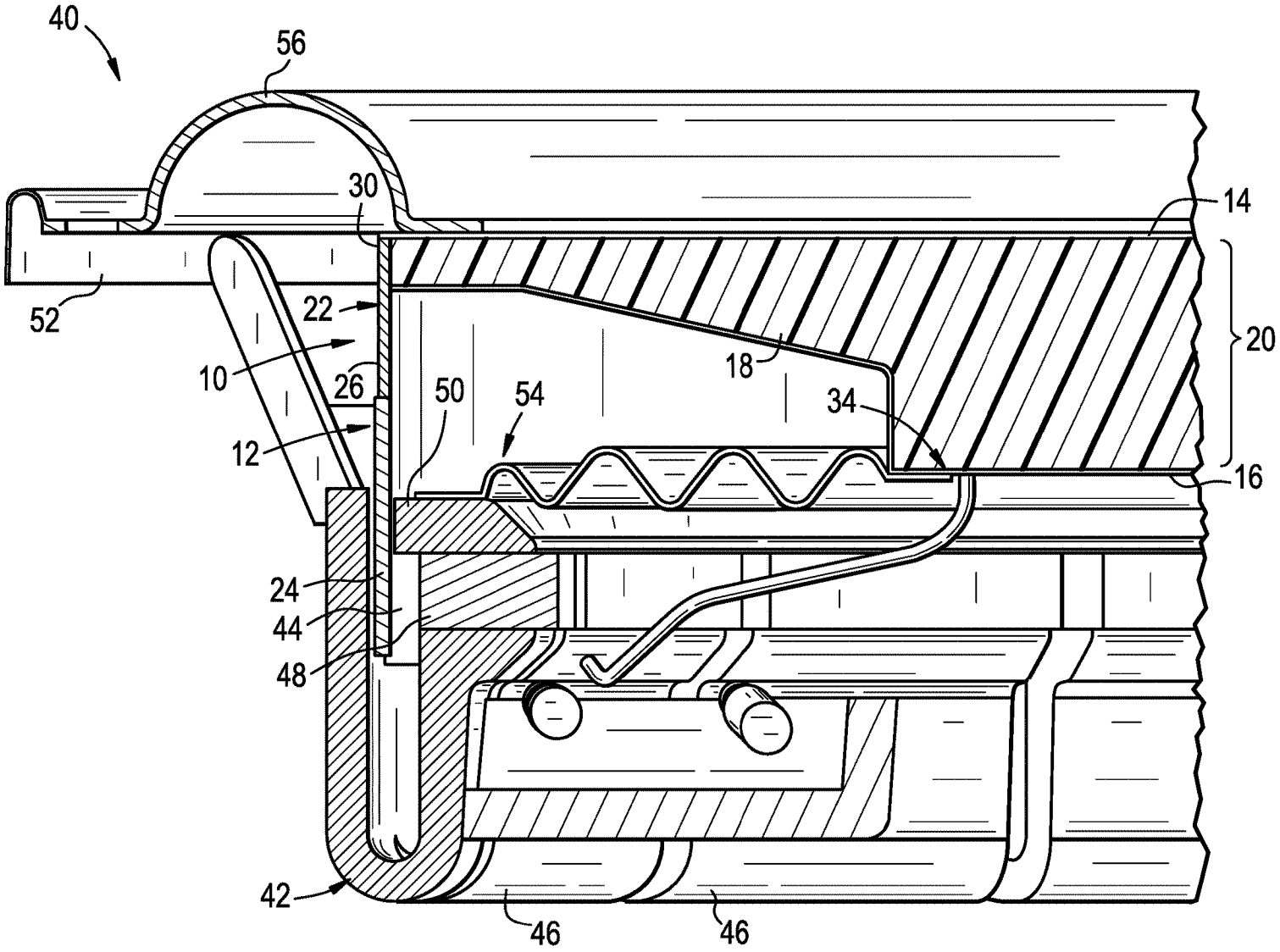
FIG. 6 is a cross-sectional view, showing the assembly of FIGS. 4 and 5 integrated into a low profile speaker.

FIG. 6 is a cross-sectional view, showing the assembly 10 of FIGS. 1-3 (for example) integrated into a low profile speaker 40. Specifically, FIG. 6 shows the periphery of the integrated voice coil and cone assembly 10, and how the overall assembly 10 is integrated into the low profile speaker 40.

As shown, a pole piece 42 may be provided which provides a gap 44 into which the voice coil 12 extends. The pole piece 42 may be comprised of multiple segments 46, wherein each segment 46 supports a magnet 48. As shown, each magnet 48 may be sandwiched between the pole piece 42 and a ring 50. The pole piece 42 may be connected to a frame 52 of the speaker 40, as well as to a spider 54 which connects to the bottom diaphragm skin 16. A surround 56 preferably connects to both the speaker frame 52 and to the applique 36 which is attached to the top diaphragm skin 14. As such, the integrated voice coil and cone assembly 10 is suspended via the surround 56 and the spider 54 (if provided).

Figure 7:
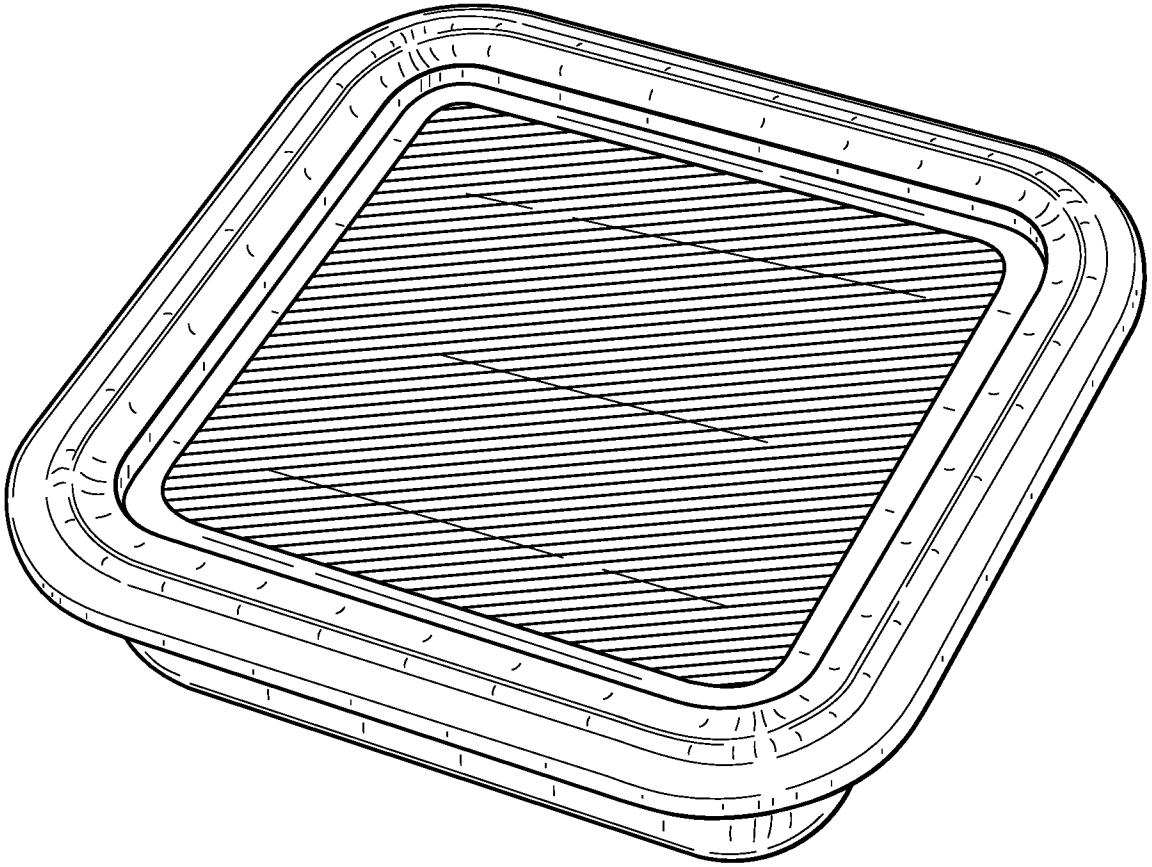
FIG. 7 is a perspective view of a square low profile speaker, which incorporates a correspondingly-shaped integrated voice coil, and cone assembly that is in accordance with an embodiment of the present invention.
Figure 8:
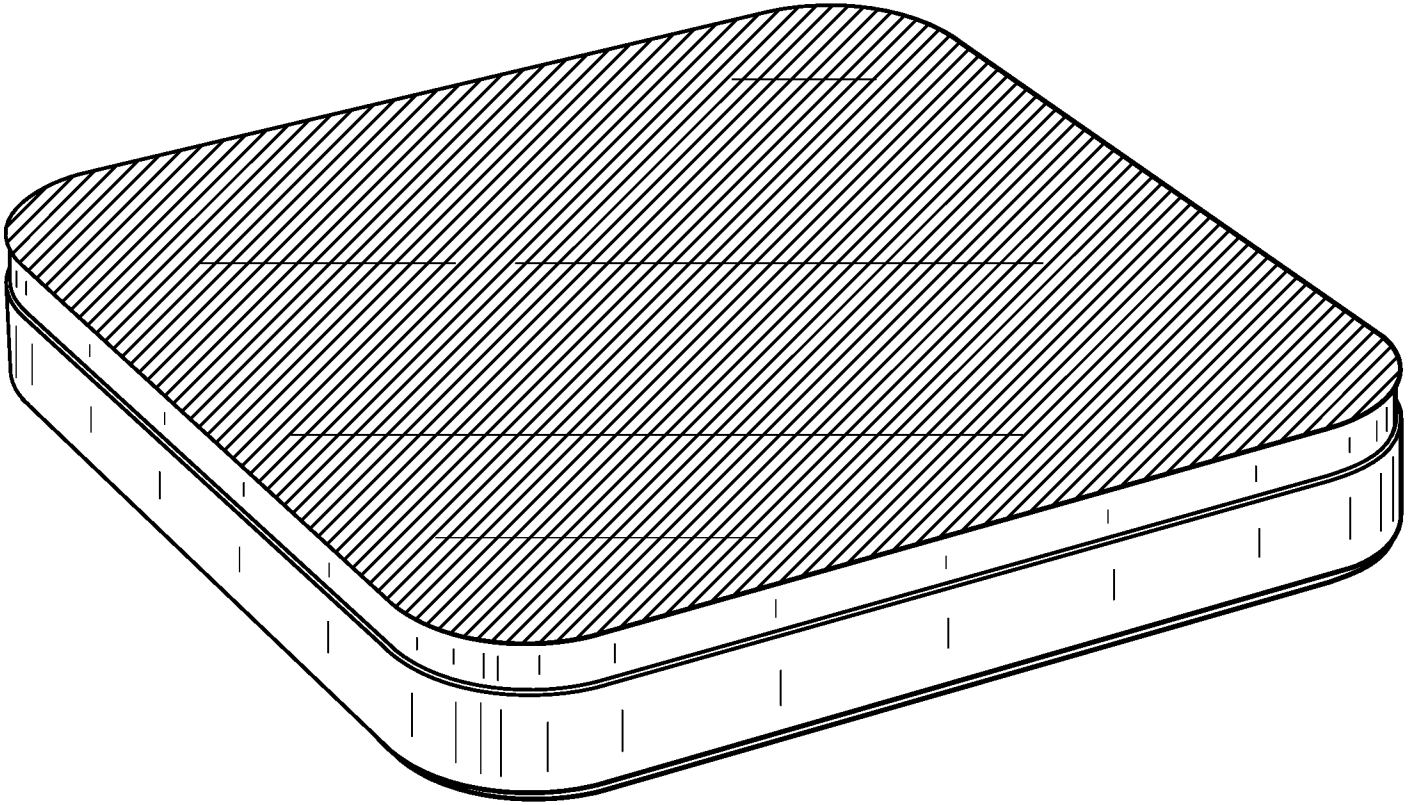
FIG. 8 is a perspective view of the integrated voice coil and cone assembly which is incorporated in the speaker shown in FIG. 7.

A speaker which incorporates an integrated voice coil and cone assembly which is in accordance with an embodiment of the present invention can take many different shapes. FIG. 7 shows a specific embodiment where the low profile speaker is square. In this case, the integrated voice coil and cone assembly would have a corresponding shape, as shown in FIG. 8.

Figure 9:
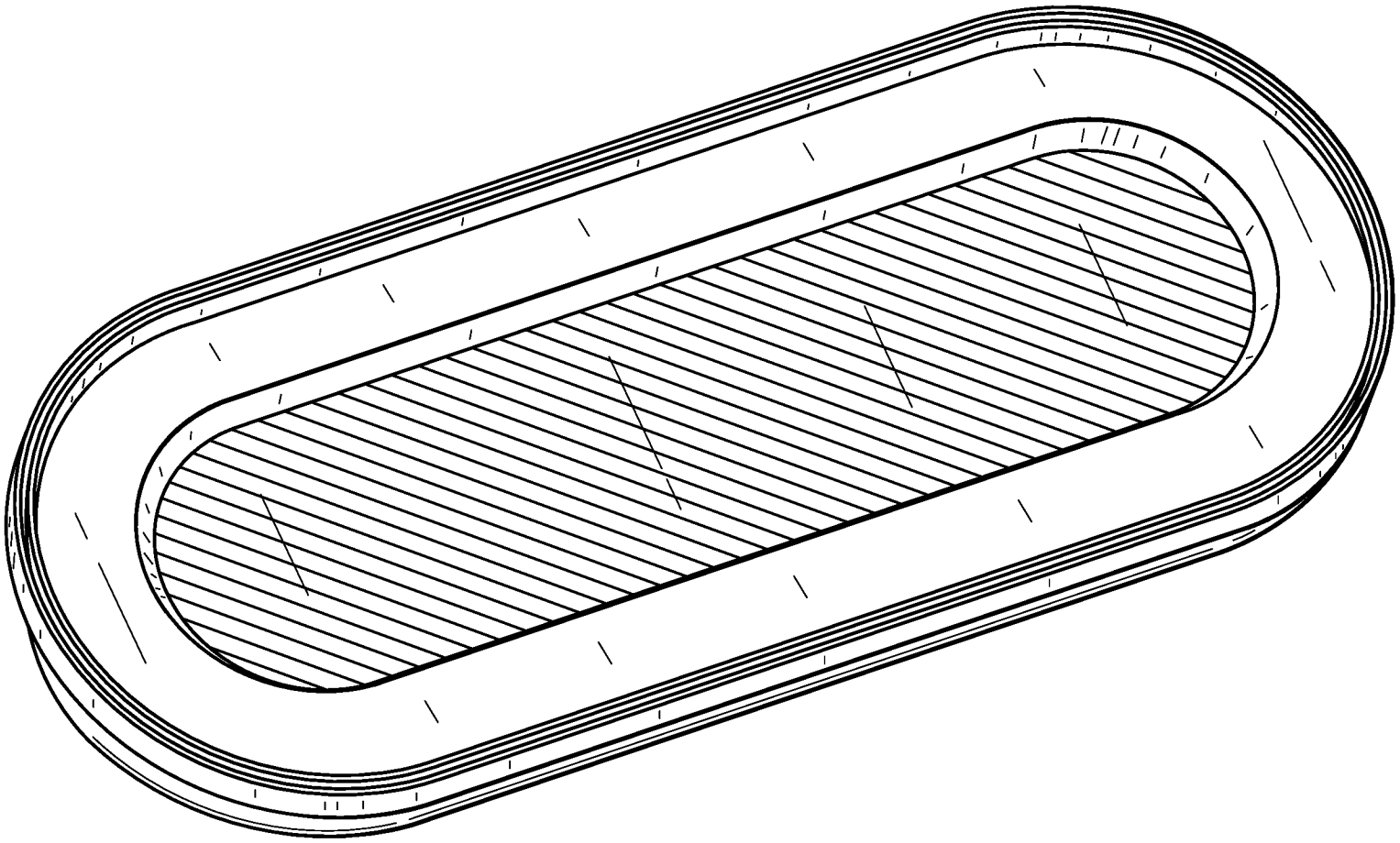
FIG. 9 is a perspective view of an oblong low profile speaker which incorporates a correspondingly-shaped integrated voice coil and cone assembly that is in accordance with an embodiment of the present invention.

FIG. 9 is a perspective view similar to FIG. 7, but shows an embodiment where the low profile speaker is oblong. In this embodiment, the integrated voice coil and cone assembly which is incorporated therein would have a corresponding, oblong shape.

Figure 10:
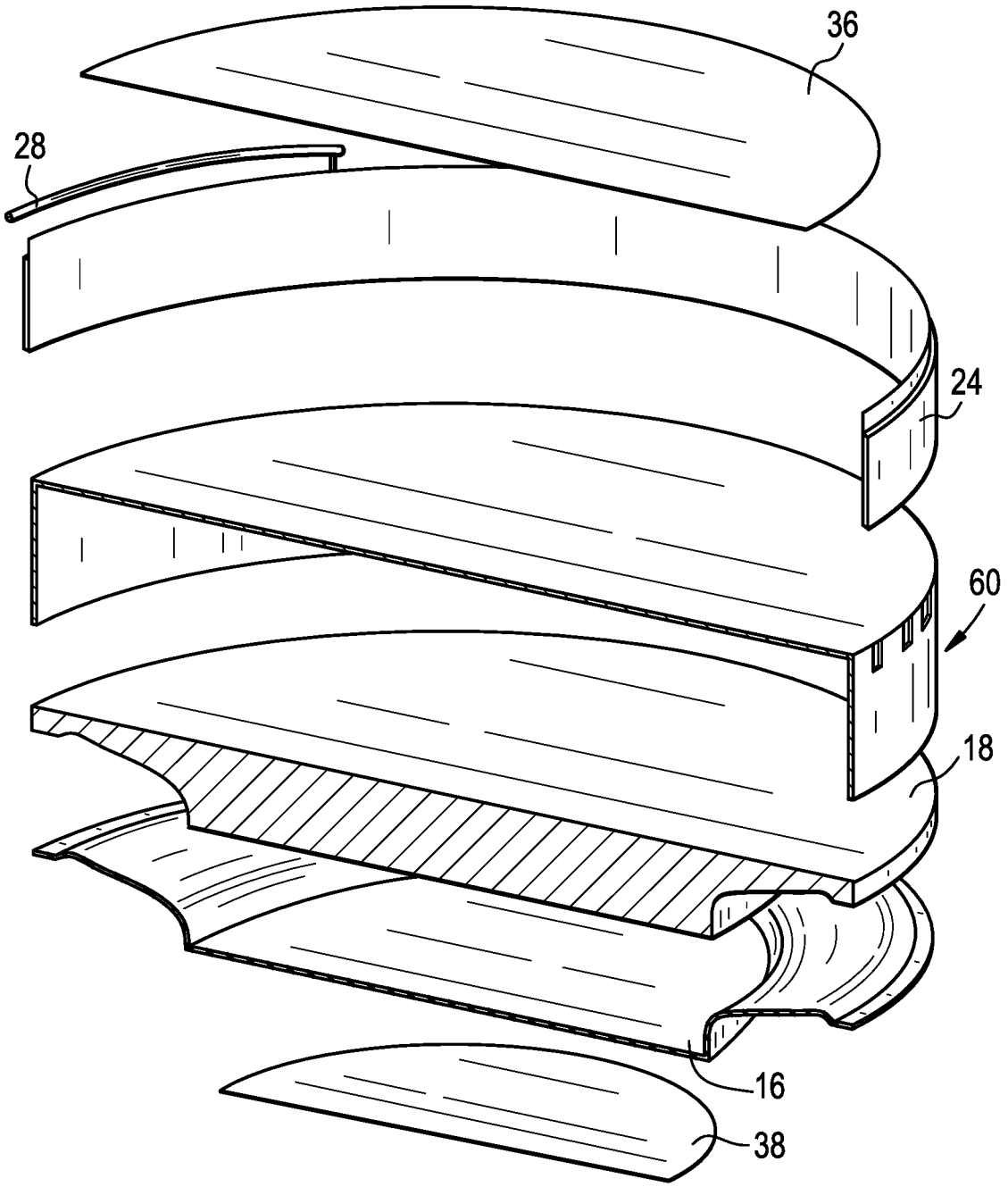
FIG. 10 is an exploded perspective view of an alternative embodiment of the present invention, which comprises a capped former.

FIG. 10 is an exploded perspective view of an alternative embodiment of the present invention, which comprises a capped former 60. This embodiment omits a top diaphragm skin, and instead has the capped former component 60. In this embodiment, the winding 24 on the former 60 is either pre-wound (i.e., wound onto the capped former 60 before foam bonding it together with the other parts), or post-wound (i.e., wound onto the capped former 60 after all the parts are foam bonded together), and then the appliques 36, 38 are applied.

All of the embodiments disclosed provides an integrated voice coil and cone assembly with increased stiffness and strength of the entire diaphragm structure, yet is light weight, thereby maximizing resiliency and minimizing distortion for improved sound quality.

In another aspect, embodiments of the invention provide a method of manufacturing an integrated voice coil and cone assembly, such as the integrated voice coil and cone assembly 10 shown in FIGS. 1-3. The method includes aligning an interior surface of a ring-shaped voice coil 12 with a perimeter edge of a cone assembly, and attaching the voice coil 12 to the perimeter edge of the cone assembly, the cone assembly comprising the top diaphragm skin 14 and bottom diaphragm skin 16. Attaching the voice coil 12 to the perimeter edge of the cone assembly calls for filling the entire space 20 between the top diaphragm skin 14 and bottom diaphragm skin 16 with an adhesive 18, which bonds the top diaphragm skin 14, bottom diaphragm skin 16, and voice coil 12 into a single, integral unit 10.

An embodiment of the method includes filling an entire space 20 between the top diaphragm skin 14 and bottom diaphragm skin 16 with polyurethane foam. In certain embodiments, the method calls for filling an entire space 20 between the top diaphragm skin 14 and bottom diaphragm skin 16 with a polyurethane foam having a density of between three and five pounds per cubic foot. In a more particular embodiment, the method includes filling an entire space 20 between the top diaphragm skin 14 and bottom diaphragm skin 16 with polyurethane foam having a density of approximately four pounds per cubic foot. The method may include allowing the adhesive 18 to set until it becomes rigid.

Embodiments of the method include aligning an interior surface of a ring-shaped voice coil 12 with a perimeter edge of a cone assembly having a stacked top diaphragm skin 14 and bottom diaphragm skin 16, wherein the top and bottom diaphragm skins 14 and 16, respectively, are comprised of paper, composite, plastic or metal(s).

In a further embodiment, the method includes aligning an interior surface of a ring-shaped voice coil 12 with a perimeter edge of a cone assembly having a stacked top diaphragm skin 14 and bottom diaphragm skin 16, wherein one of the top diaphragm skin and bottom diaphragm skin (i.e., either skin 14 or 16) is flat while the other of the top diaphragm skin and bottom diaphragm skin (i.e., either skin 16 or skin 14) has a recessed area 34.

The process disclosed herein establishes a true form shape by placing the former (i.e., 22 or 60) over a foaming mandrel during the foaming process. Therefore, it takes a set which is true to the gap in the motor where it must be centered. This is extremely beneficial to the assembly operation and resulting quality. This applies in the case where the cone assembly and voice coil are round, but especially applies in the case where the cone assembly and voice coil are provided in different shapes (i.e., obround, square, polygonal) in developing a matching form with the motor which results in TD efficiency and audio output.

An embodiment of the present invention provides a method of manufacturing a cone assembly, where the method comprises providing either a capped former 60 or a top diaphragm skin 14, providing a bottom diaphragm skin 16, and installing a settable foam or other adhesive material 18 between the bottom diaphragm skin 16 and either the capped former 60 or the top diaphragm skin 14, thereby forming the cone assembly.

There are many different methods which can be employed to make the various integrated assemblies described herein. One of those methods will now be described on a step-by-step basis. First, a voice coil is formed, such as part 12 in FIGS. 1-3.

The voice coil 12 is then preferably installed on a mandrel which has an outer circumference or shape which generally corresponds to an inner circumference or shape of the voice coil 12.

The voice coil 12 is covered with tape or a plastic seal to protect it from the foaming process.

The bottom skin 16 is installed on the voice coil mandrel feature, inside the voice coil 12. The top skin 14 is preferably installed onto a mandrel fixture top plate, such that the top skin 14 is flush with its outside surface. The foam 18 is mixed, and then poured or injected into the mandrel and bottom skin 16. The overall assembly may be rocked or swirled in order to make sure the foam 18 is more evenly distributed. Once the foam mixture 18 has been generously applied and begins to expand, the top plate fixture is turned over to close tool set and a weight is placed thereon or a locking clamp system is used to give the foam 18 time complete expansion and set. The top plate fixture is then removed, and excess foam which has come out the holes 32 in the voice coil 12 is removed. If masking tape or a seal was used, it is removed. Forced air may be used to remove the integrated voice coil and cone assembly 10 from the mandrel.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments might become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An integrated voice coil and cone assembly comprising:

a cone assembly having a top diaphragm skin and a bottom diaphragm skin with a space between the top diaphragm skin and bottom diaphragm skin;

a voice coil configured to engage the cone assembly along a perimeter edge thereof; and an adhesive material placed between the top diaphragm skin and bottom diaphragm skin such that the adhesive material fills all of space between the top and bottom diaphragm skins, and bonds the top diaphragm skin, bottom diaphragm skin, and voice coil into a single unit, wherein the adhesive material and the top diaphragm skin are formed of different materials.

2. The integrated voice coil and cone assembly of claim 1, wherein the adhesive material is polyurethane foam.

3. The integrated voice coil and cone assembly of claim 1, wherein, after application, the adhesive material becomes rigid.

4. The integrated voice coil and cone assembly of claim 1, wherein one of the top diaphragm skin and bottom diaphragm skin is flat while the other of the top diaphragm skin and bottom diaphragm skin has a recessed area.

5. The integrated voice coil and cone assembly of claim 1, wherein the top and bottom diaphragm skin are circular and of the same diameter, and wherein the voice coil engages the top and bottom diaphragm skins along the entire circumference of both top and bottom diaphragm skins.

6. The integrated voice coil and cone assembly of claim 1, wherein the top and bottom diaphragm skins are comprised of paper, composite, plastic or metal.

7. The integrated voice coil and cone assembly of claim 1, wherein the voice coil is ring-shaped comprising a former, with a plurality of holes around a circumference of the former, the plurality of holes located such that the adhesive flows through the holes.

8. The integrated voice coil and cone assembly of claim 1, wherein the cone assembly and voice coil have a non-round shape.

9. The integrated voice coil and cone assembly of claim 8, wherein the non-round shape is obround, square or polygonal.

10. A method of manufacturing an integrated voice coil and cone assembly, the method comprising:

aligning an interior surface of a ring-shaped voice coil with a perimeter edge of a cone attaching the voice coil to the perimeter edge of the cone assembly, the cone assembly comprising a top diaphragm skin and bottom diaphragm skin;

wherein attaching the voice coil to the perimeter edge of die cone assembly comprises filling an entire space between the top diaphragm skin and bottom diaphragm skin with an adhesive, which bonds the top diaphragm skin, bottom diaphragm skin, and voice coil into a single, integral unit, wherein the adhesive material and the top diaphragm skin are formed of different materials.

11. The method of claim 10, wherein filling an entire space between the top diaphragm skin and bottom diaphragm skin with an adhesive comprises filling an entire space between the top diaphragm skin and bottom diaphragm skin with a polyurethane foam.

12. The method of claim 10, further comprising allowing the adhesive to set until it becomes rigid.

13. The method of claim 10, wherein aligning an interior surface of a ring-shaped voice coil with a perimeter edge of a cone assembly comprises aligning an interior surface of a ring-shaped voice coil with a perimeter edge of a cone assembly having a stacked top diaphragm skin and bottom diaphragm skin, wherein the top and bottom diaphragm skins are comprised of paper, composite, plastic or metal.

14. The method of claim 10, wherein aligning an interior surface of a ring-shaped voice coil with a perimeter edge of a cone assembly comprises aligning an interior surface of a ring-shaped voice coil with a perimeter edge of a cone assembly having a stacked top diaphragm skin and bottom diaphragm skin, wherein one of the top diaphragm skin and bottom diaphragm skin is flat while the other of the top diaphragm skin and bottom diaphragm skin has a recessed area.

15. The method of claim 10, further comprising providing that the cone assembly and voice coil have a non-round shape.

16. The method of claim 10, further comprising providing that the non-round shape is obround, square or polygonal.

17. A method of manufacturing a cone assembly, the method comprising; providing either a capped former or a top diaphragm skin;

providing a bottom diaphragm skin; and installing a settable foam between the bottom diaphragm skin and either the capped former or the top diaphragm skin, thereby forming the cone assembly, wherein the settable foam and the top diaphragm skin are formed of different materials.

18. The integrated voice coil and cone assembly of claim 1, wherein both the top diaphragm skin and the bottom diaphragm skin are formed of paper and the adhesive material is polyurethane foam.

19. The method of claim 10, wherein both the top diaphragm skin and the bottom diaphragm skin are formed of paper and the adhesive material is polyurethane foam.

20. The method of claim 17, wherein both the top diaphragm skin and the bottom diaphragm skin are formed of paper and the settable foam is polyurethane foam.

* * * * *